US007383950B1

(12) United States Patent
Roberts et al.

(10) Patent No.: US 7,383,950 B1
(45) Date of Patent: Jun. 10, 2008

(54) COMBINED UNIQUELY DIMENSIONED CIGARETTES AND ASSOCIATED PACKAGING

(76) Inventors: Dean Roberts, 91 Broad St., Whitman, MA (US) 02382; Michelle J. Roberts, 91 Broad St., Whitman, MA (US) 02382

( * ) Notice: Subject to any disclaimer, the term of this patent is extended or adjusted under 35 U.S.C. 154(b) by 402 days.

(21) Appl. No.: 11/094,600

(22) Filed: Mar. 31, 2005

(51) Int. Cl.
*B65D 85/10* (2006.01)

(52) U.S. Cl. ..... 206/256; 229/160.1

(58) Field of Classification Search ..... 206/242–275; 229/160.1

See application file for complete search history.

(56) References Cited

U.S. PATENT DOCUMENTS 1,225,092 A 5/1917 Williams
2,039,559 A * 5/1936 Segal ..... 206/250
2,306,613 A 12/1942 Chesley
2,783,929 A * 3/1957 Delaney ..... 206/273
3,081,867 A * 3/1963 Corey ..... 206/248
3,420,360 A * 1/1969 Young ..... 206/259
3,589,505 A 6/1971 Burniski
4,303,154 A 12/1981 Hicks
D408,942 S 4/1999 Fanning et al.
D448,888 S 10/2001 Focke et al.

* cited by examiner

*Primary Examiner*—Bryon P Gehman

(57) ABSTRACT

A cigarette kit includes a case that has a plurality of monolithically formed sidewalls defining a cavity therebetween. One sidewall defines a planar bottom surface of the case. The case includes a lid pivotally conjoined therewith and has a fulcrum axis about which the lid is adaptable. An insert is positioned within the cavity and has a first top surface offset and parallel from the bottom surface. A plurality of cigarettes are storable in the cavity wherein selected ones of the cigarettes have bottom end portions situated on the bottom surface and other ones of the cigarettes have bottom end portions situated on the first top surface respectively. The cigarettes have uniquely dimensioned longitudinal lengths that include at least two cigarettes selected from the group including a small cigarette, a medium cigarette, a large cigarette, and any combination thereof.

18 Claims, 2 Drawing Sheets

COMBINED UNIQUELY DIMENSIONED CIGARETTES AND ASSOCIATED PACKAGING

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to cigarette packaging and, more particularly, to combined cigarettes and associated method of packaging.

2. Prior Art

Over the past years, the price of tobacco and tobacco-related products has greatly increased. This is due both to general market trends and an attempt to discourage people from smoking excessively, due to the health risk related therewith. Unfortunately, people often find themselves lighting up a cigarette, but then not having enough time to finish the cigarette.

Presently, they are faced with the option of discarding the unfinished cigarette or saving it. Most people opt for discarding the unfinished cigarette because an unfinished cigarette tends to emit a foul odor, thus it is unpleasant to keep it on your person. When taking into consideration the price of cigarettes, it becomes obvious that this practice of discarding unfinished cigarettes can be quite costly to the consumer since they are paying for a product that they do not get to use.

Unfortunately, cigarettes are sold in uniform packs, which contain cigarettes all of the same size. The current form of cigarette packs also does not provide a method for packing differently sized cigarettes therein, should the need therefore arise. Thus, a consumer remains stuck with the decision to either throw away a partially smoked cigarette, or keep it on their person, and dealing with the odor associated therewith.

Accordingly, a need remains for combined cigarettes and associated packaging in order to overcome the above-noted shortcomings. The present invention satisfies such a need by providing combined cigarettes and packaging that is practical in design, convenient, provides money savings, and is convenient to use. The new method of producing and packaging cigarettes provides individuals with a convenient alternative to the standard cigarette. The smaller cigarettes can be consumed when one has limited time while larger ones can be consumed during leisure time, thus saving the user time and money by not having to waste their cigarettes.

BRIEF SUMMARY OF THE INVENTION

In view of the foregoing background, it is therefore an object of the present invention to provide combined cigarettes and associated packaging method. These and other objects, features, and advantages of the invention are provided by a reusable and portable cigarette kit for use in the tobacco industry.

The cigarette kit includes a case that has a plurality of monolithically formed sidewalls sized and shaped for defining a substantially rectangular cavity therebetween. Such a case further has a centrally located longitudinal axis bifurcating selected ones of the sidewalls wherein the selected sidewalls are equidistantly spaced and extend substantially parallel to the longitudinal axis.

Another one of the sidewalls is registered along a substantially horizontal plane and situated medially of the selected sidewalls for defining a planar bottom surface of the case. The case includes a lid section pivotally conjoined therewith and has a fulcrum axis about which the lid is conveniently adaptable between open and closed positions. Such a fulcrum axis is defined along a linear axis extending along an entire length of one of the selected sidewalls and parallel to the longitudinal axis. The lid preferably includes a plurality of monolithically formed sidewalls defining a substantially rectangular cavity for cooperating with the case cavity when the lid is adapted to the closed position such that the lid cavity and the case cavity become vertically registered in fluid communication with each other.

An insert is positioned within the cavity and has a first top surface vertically offset from the bottom surface of the case. Such an insert is sized and shaped to nest within the cavity such that the first top surface spans across a width of the cavity and a portion of a longitudinal length of the cavity. The first top surface is registered along a horizontal plane and parallel to the bottom surface. The insert preferably has a stepped body uniformly rising within the case cavity and along the longitudinal axis.

The insert may further include a second top surface vertically offset from the first top surface and juxtaposed within the cavity subjacent to the lid. Such a second top surface has a fixed vertical spatial relationship with the first top surface and the first top surface has a fixed vertical spatial relationship with the bottom surface. The first and second vertical spatial relationships are preferably equidistantly adjoined along the longitudinal axis such that an equal quantity of the cigarettes can be supported on the bottom surface and the first and second top surfaces respectively.

A plurality of cigarettes are advantageously removably storable in the cavity wherein selected ones of the cigarettes have bottom end portions situated on the bottom surface and other ones of the cigarettes have bottom end portions situated on the first top surface respectively. Such cigarettes have uniquely dimensioned longitudinal lengths such that each cigarette can conveniently be housed within a unique region of the cavity. The cigarettes include at least two cigarettes selected from the group including a small cigarette, a medium cigarette, a large cigarette and any combination thereof. The cigarettes may further have top end portions protruding upwardly and away from the case cavity when housed therein.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to like elements in alternate embodiments.

Figure 1:
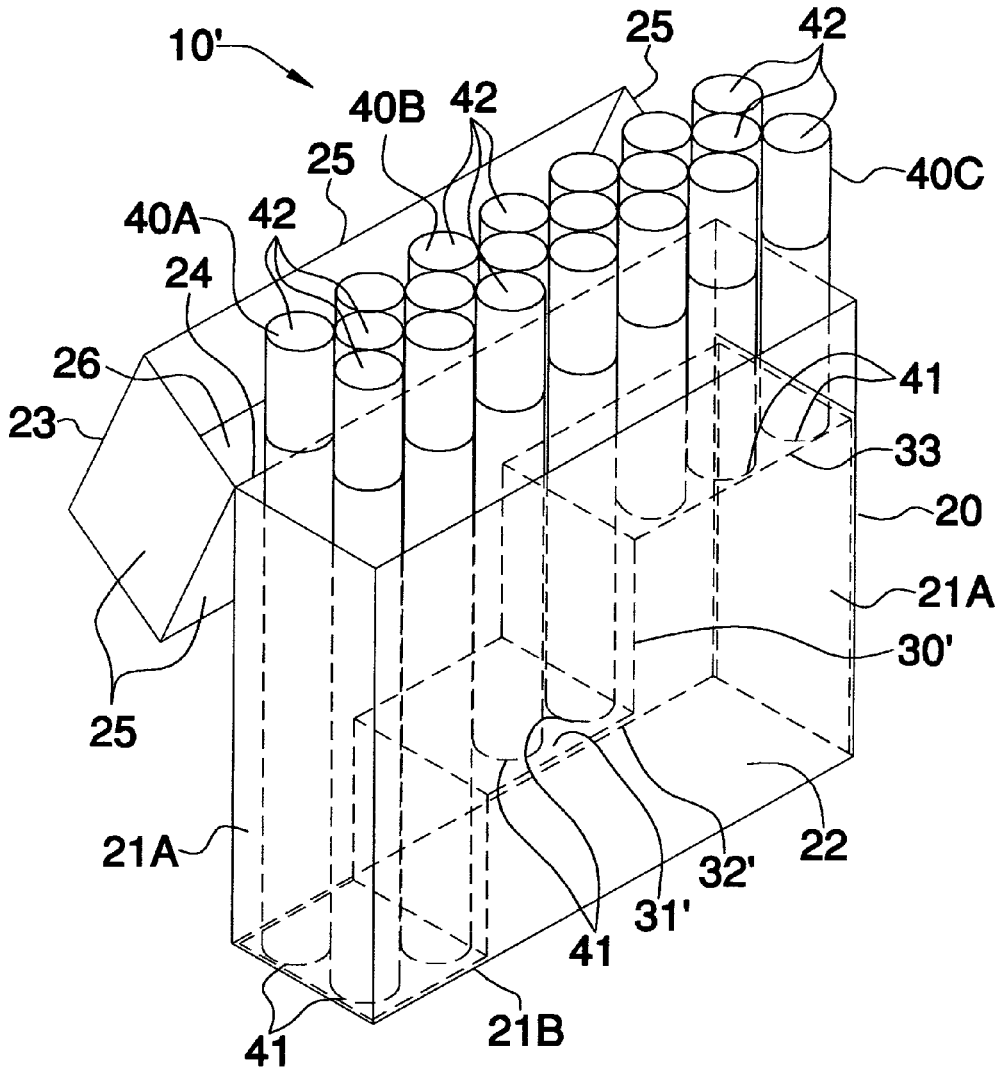
FIG. 1 is a perspective view showing a kit for combined cigarettes and associated packaging, in accordance with the present invention.
Figure 2:
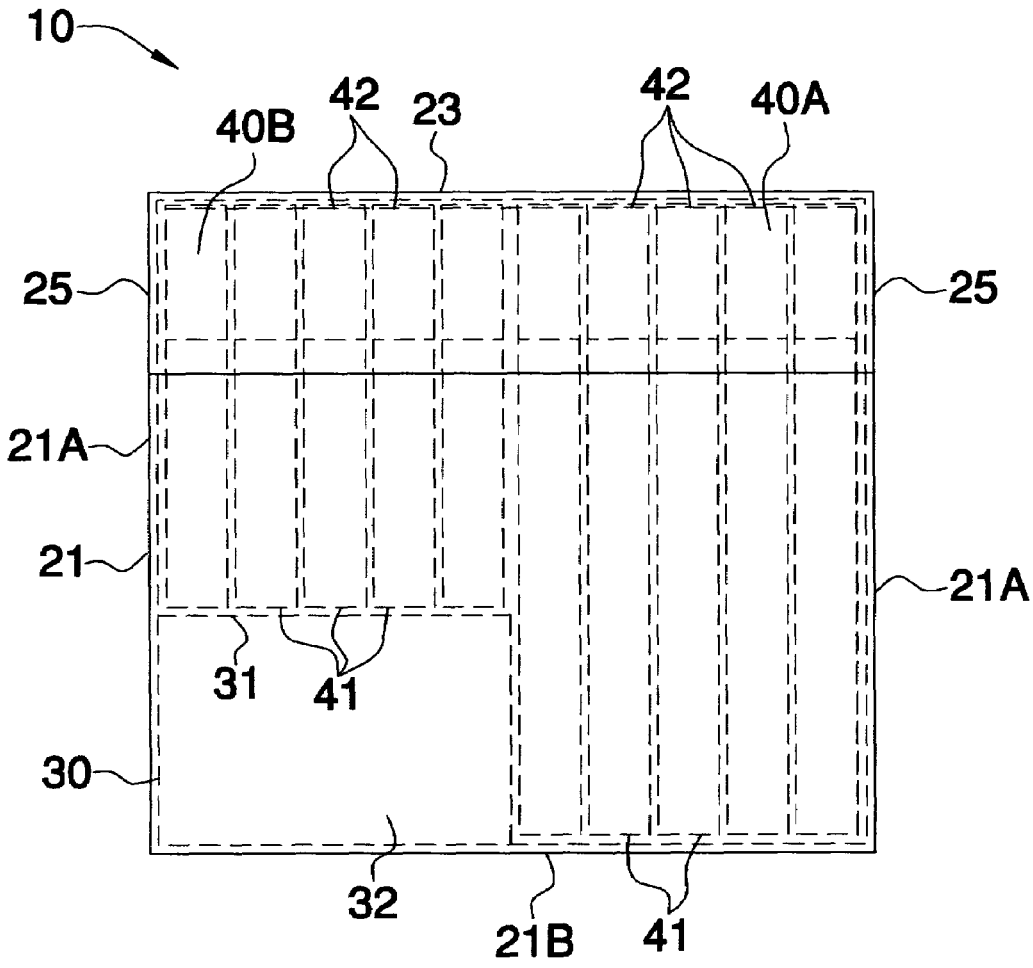
FIG. 2 is a side elevational view of the kit shown in FIG. 1.

The kit of this invention is referred to generally in FIGS. 1-2 by the reference numeral 10 and is intended to provide combined cigarettes and their associated packaging method. It should be understood that the kit 10 may be used to package many different types of alternately shaped products and should not be limited in use to only packaging cigarettes.

Referring initially to FIG. 1, the kit 10 includes a case 20 that has a plurality of monolithically formed sidewalls 21 sized and shaped for defining a substantially rectangular cavity 22 therebetween. Of course, the case 20 may be produced in a variety of different shapes and sizes, as is obvious to a person of ordinary skill in the art. Such a case 20 further has a centrally located longitudinal axis bifurcating selected ones 21A of the sidewalls 21 wherein the selected sidewalls 21A are equidistantly spaced and extend substantially parallel to the longitudinal axis.

Referring to FIGS. 1 and 2, another one 21B of the sidewalls 21 is registered along a substantially horizontal plane and situated medially of the selected sidewalls 21A for defining a planar bottom surface of the case 20. The case 20 includes a lid section 23 pivotally conjoined therewith and has a fulcrum axis 24 about which the lid 23 is conveniently adaptable between open and closed positions. Such a fulcrum axis 24 is defined along a linear axis extending along an entire length of one of the selected sidewalls 21A and parallel to the longitudinal axis. The lid 23 includes a plurality of monolithically formed sidewalls 25 defining a substantially rectangular cavity 26 for cooperating with the case cavity 22 when the lid 23 is adapted to the closed position such that the lid cavity 26 and the case cavity 22 become vertically registered in fluid communication with each other. This feature conveniently allows the cigarettes 40 (described herein below) to be stored in such a manner that their top end portion 42 is easily graspable by a user, while not damaging the cigarettes 40.

Referring to FIG. 2, an insert 30 is positioned within the case cavity 22 and has a first top surface 31 vertically offset from the bottom surface 21B of the case 20. Such an insert 30 is sized and shaped to nest within the cavity 22 such that the first top surface 31 spans across a width of the cavity 22 and a portion of a longitudinal length of the cavity 22. The first top surface 31 is registered along a horizontal plane and parallel to the bottom surface 21B. The insert 30 has a stepped body 32 uniformly rising within the case cavity 22 and along the longitudinal axis.

Referring to FIG. 1, in an alternate embodiment 10', the insert 30' further includes a second top surface 33 vertically offset from the first top surface 31' and juxtaposed within the cavity 22 subjacent to the lid 23. Such a second top surface 33 has a fixed vertical spatial relationship with the first top surface 31' and the first top surface 31' has a fixed vertical spatial relationship with the bottom surface 21B. The first and second vertical spatial relationships are equidistantly adjoined along the longitudinal axis such that an equal quantity of the cigarettes 40 can be supported on the bottom surface 21B and the first 31' and second 33 top surfaces respectively.

Referring to FIGS. 1 and 2, a plurality of cigarettes 40 are advantageously removably storable in the cavity 22 wherein selected ones 40A of the cigarettes 40 have bottom end portions 41 situated on the bottom surface 21B and other ones 40B of the cigarettes 40 have bottom end portions 41 situated on the first top surface 31 respectively. Such cigarettes 40 have uniquely dimensioned longitudinal lengths such that each cigarette 40 can conveniently be housed within a unique region of the cavity 22. The cigarettes 40 include at least two cigarettes 40 selected from the group including a small cigarette 40C, a medium cigarette 40B, a large cigarette 40A, and any combination thereof. Such a combination of cigarettes 40 conveniently allows a smoker to choose an appropriately sized cigarette 40 depending on the amount of time they will have to finish the cigarette 40. This will advantageously eliminate the need to discard a partially smoked cigarette 40, thus saving the user a considerable amount of money.

The cigarettes 40 further have top end portions 42 protruding upwardly and away from the case cavity 22 when housed therein. Such top end portions 42 may, of course, be color coded or have surface indicia thereon, in order to conveniently indicate what size of cigarette 40 the individual is taking from the case 20, as is obvious to a person of ordinary skill in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. A reusable and portable cigarette kit for use in the tobacco industry, said cigarette kit comprising:

a case having a plurality of monolithically formed sidewalls sized and shaped for defining a substantially rectangular cavity therebetween, said case further having a centrally located longitudinal axis bifurcating selected ones of said sidewalls wherein said selected sidewalls are equidistantly spaced and extend substantially parallel to the longitudinal axis, another one of said sidewalls being registered along a substantially horizontal plane and situated medially of said selected sidewalls for defining a planar bottom surface of said case, said case including a lid pivotally conjoined therewith and having a fulcrum axis about which said lid is adaptable between open and closed positions wherein the fulcrum axis is defined along a linear axis extending along an entire length of one said selected sidewalls and parallel to the longitudinal axis;

an insert positioned within the cavity and having a first top surface vertically offset from said bottom surface of said case, said insert being sized and shaped to nest within the cavity such that said first top surface spans across a width of the cavity and a portion of a longitudinal length of the cavity; and a plurality of cigarettes removably stored in the cavity wherein selected ones of said cigarettes have bottom end portions situated on said bottom surface and other ones of said cigarettes have bottom end portions situated on said first top surface respectively, said cigarettes having uniquely dimensioned longitudinal lengths such that each said cigarette can be housed within a unique region of the cavity.

2. The cigarette kit of claim 1, wherein said insert further comprises: a second top surface vertically offset from said first top surface and juxtaposed within the cavity subjacent said lid, said second top surface having a fixed vertical spatial relationship with said first top surface, said first top surface having a fixed vertical spatial relationship with said bottom surface.

3. The cigarette kit of claim 2, wherein the first and second vertical spatial relationships being equidistantly adjoined along the longitudinal axis such that an equal quantity of said cigarettes can be supported on said bottom surface and said first and second top surfaces respectively.

4. The cigarette kit of claim 1, wherein said lid comprises: a plurality of monolithically formed sidewalls defining a substantially rectangular cavity for cooperating with said case cavity when said lid is adapted to the closed position such that said lid cavity and said case cavity become vertically registered in fluid communication with each other.

5. The cigarette kit of claim 1, wherein said insert has a stepped body uniformly rising within said case cavity and along the longitudinal axis.

6. The cigarette kit of claim 1, wherein said cigarettes further have top end portions protruding upwardly and away from said case cavity when housed therein.

7. A reusable and portable cigarette kit for use in the tobacco industry, said cigarette kit comprising:

a case having a plurality of monolithically formed sidewalls sized and shaped for defining a substantially rectangular cavity therebetween, said case further having a centrally located longitudinal axis bifurcating selected ones of said sidewalls wherein said selected sidewalls are equidistantly spaced and extend substantially parallel to the longitudinal axis, another one of said sidewalls being registered along a substantially horizontal plane and situated medially of said selected sidewalls for defining a planar bottom surface of said case, said case including a lid pivotally conjoined therewith and having a fulcrum axis about which said lid is adaptable between open and closed positions wherein the fulcrum axis is defined along a linear axis extending along an entire length of one said selected sidewalls and parallel to the longitudinal axis;

an insert positioned within the cavity and having a first top surface vertically offset from said bottom surface of said case, said insert being sized and shaped to nest within the cavity such that said first top surface spans across a width of the cavity and a portion of a longitudinal length of the cavity, said first top surface being registered along a horizontal plane and parallel to said bottom surface; and a plurality of cigarettes removably stored in the cavity wherein selected ones of said cigarettes have bottom end portions situated on said bottom surface and other ones of said cigarettes have bottom end portions situated on said first top surface respectively, said cigarettes having uniquely dimensioned longitudinal lengths such that each said cigarette can be housed within a unique region of the cavity.

8. The cigarette kit of claim 7, wherein said insert further comprises: a second top surface vertically offset from said first top surface and juxtaposed within the cavity subjacent said lid, said second top surface having a fixed vertical spatial relationship with said first top surface, said first top surface having a fixed vertical spatial relationship with said bottom surface.

9. The cigarette kit of claim 8, wherein the first and second vertical spatial relationships being equidistantly adjoined along the longitudinal axis such that an equal quantity of said cigarettes can be supported on said bottom surface and said first and second top surfaces respectively.

10. The cigarette kit of claim 7, wherein said lid comprises: a plurality of monolithically formed sidewalls defining a substantially rectangular cavity for cooperating with said case cavity when said lid is adapted to the closed position such that said lid cavity and said case cavity become vertically registered in fluid communication with each other.

11. The cigarette kit of claim 7, wherein said insert has a stepped body uniformly rising within said case cavity and along the longitudinal axis.

12. The cigarette kit of claim 7, wherein said cigarettes further have top end portions protruding upwardly and away from said case cavity when housed therein.

13. A reusable and portable cigarette kit for use in the tobacco industry, said cigarette kit comprising:

a case having a plurality of monolithically formed sidewalls sized and shaped for defining a substantially rectangular cavity therebetween, said case further having a centrally located longitudinal axis bifurcating selected ones of said sidewalls wherein said selected sidewalls are equidistantly spaced and extend substantially parallel to the longitudinal axis, another one of said sidewalls being registered along a substantially horizontal plane and situated medially of said selected sidewalls for defining a planar bottom surface of said case, said case including a lid pivotally conjoined therewith and having a fulcrum axis about which said lid is adaptable between open and closed positions wherein the fulcrum axis is defined along a linear axis extending along an entire length of one said selected sidewalls and parallel to the longitudinal axis;

an insert positioned within the cavity and having a first top surface vertically offset from said bottom surface of said case, said insert being sized and shaped to nest within the cavity such that said first top surface spans across a width of the cavity and a portion of a longitudinal length of the cavity, said first top surface being registered along a horizontal plane and parallel to said bottom surface; and a plurality of cigarettes removably stored in the cavity wherein selected ones of said cigarettes have bottom end portions situated on said bottom surface and other ones of said cigarettes have bottom end portions situated on said first top surface respectively, said cigarettes having uniquely dimensioned longitudinal lengths such that each said cigarette can be housed within a unique region of the cavity, said cigarettes comprising at least two cigarettes selected from the group including a small cigarette, a medium cigarette, a large cigarette and any combination thereof.

14. The cigarette kit of claim 13, wherein said Insert further comprises: a second top surface vertically offset from said first top surface and juxtaposed within the cavity subjacent said lid, said second top surface having a fixed vertical spatial relationship with said first top surface, said first top surface having a fixed vertical spatial relationship with said bottom surface.

15. The cigarette kit of claim 14, wherein the first and second vertical spatial relationships being equidistantly adjoined along the longitudinal axis such that an equal quantity of said cigarettes can be supported on said bottom surface and said first and second top surfaces respectively.

16. The cigarette kit of claim 13, wherein said lid comprises: a plurality of monolithically formed sidewalls defining a substantially rectangular cavity for cooperating with said case cavity when said lid is adapted to the closed position such that said lid cavity and said case cavity become vertically registered in fluid communication with each other.

17. The cigarette kit of claim 13, wherein said insert has a stepped body uniformly rising within said case cavity and along the longitudinal axis.

18. The cigarette kit of claim 13, wherein said cigarettes further have top end portions protruding upwardly and away from said case cavity when housed therein.

* * * * *